United States Patent [19]

Graveman

[11] 4,205,795

[45] Jun. 3, 1980

[54] MATERIAL HANDLING FACILITY

[75] Inventor: Donald F. Graveman, St. Charles, Mo.

[73] Assignee: American Pulverizer Company, St. Louis, Mo.

[21] Appl. No.: 954,911

[22] Filed: Oct. 26, 1978

[51] Int. Cl.[2] ..... B02C 13/286

[52] U.S. Cl. ..... 241/101.7; 241/189 R; 241/285 A

[58] Field of Search ..... 198/615; 222/192, 478, 222/561, 559, 526, 461, 460; 241/101.7, 189 R, 189 A, 32, 186 R, 186.3, 186.2, 285 R, 285 A

[56] References Cited

U.S. PATENT DOCUMENTS

| | | | |
|---|---|---|---|
| 2,045,691 | 6/1936 | Armstrong | 241/189 R X |
| 3,376,971 | 4/1968 | Greer et al. | 198/615 X |
| 3,690,359 | 9/1972 | Wenzel et al. | 241/101.7 |

*Primary Examiner*—Mark Rosenbaum

*Attorney, Agent, or Firm*—Gravely, Lieder & Woodruff

[57] ABSTRACT

At a coal handling facility a reducing machine is mounted on a common carriage along with a by-pass chute, and this carriage is capable of moving either the reducing machine or the by-pass chute into a position directly beneath a receiving hopper. When the by-pass chute is directly below the hopper, coal passes through that chute without interference. However, during winter months when moisture has a tendency to freeze coal together into large lumps, the carriage is moved to bring the reducing machine directly beneath the receiving hopper. The reducing machine has a rotor which engages the large lumps of frozen coal and reduces them to a size more suitable for conveyors and other coal handling equipment. Thus, the coal passes through the reducing machine only when it is necessary to break the frozen coal into smaller lumps, and this in turn prolongs the life of the reducing machine. The carriage has retractable wheels that enable it to rest on a foundation when the reducing machine or by-pass chute are in use. The carriage also has jacks for elevating it so that the wheels may be extended to and retained in an extended position for movement of the carriage along its foundation.

18 Claims, 5 Drawing Figures

MATERIAL HANDLING FACILITY

BACKGROUND OF THE INVENTION

This invention relates in general to material handling equipment and, more particularly, to a material handling facility and machine for breaking up material bonded together in large lumps.

Much of the coal that is mined in this country is delivered to the user in open railway cars or barges. As it leaves the mine this coal is normally in a lump size which is easily handled by conveyors and other handling equipment at the place of consumption. However, during the long rail or barge journey the conveyances pass through rain and snow storms and the coal acquires considerable moisture. This does not present much of a problem during the spring, summer and fall, but in winter the moisture often freezes and bonds the small lumps together into large massive lumps which block and disrupt the handling equipment. For example, a large lump, will not rise along a steeply inclined belt conveyor, but instead will tumble downwardly and carry much of the smaller lumps with it. In this regard, at many coal burning installations the coal is dumped into a hopper which is located in a pit. The hopper funnels the coal onto a belt conveyor that rises steeply out of the pit and delivers the coal eventually to the area at which it is consumed. Large frozen lumps of coal also tend to lodge in restricted areas of the conveying equipment, or are lese incapable of entering such restricted areas, in which case they produce jams that disrupt the equipment.

To overcome these problems frozen coal crackers have been developed. The typical frozen coal cracker is a large machine that is mounted on a permanent foundation at the base of the receiving hopper. This machine has a large slow-turning rotor that is provided teeth which pass by a breaker bar. All coal that is dumped into the receiving hopper passes through the machine, but only during the winter does the machine serve any purpose, since it breaks the large frozen lumps into lumps that are small enough to be handled by the conveying equipment. During the warmer months the machine merely stands idle with its breaker bar backed off from the rotor so that the coal passes freely through the machine. This, however, causes unnecessary wear on the rotor, and indeed the wear caused by the free falling coal often exceeds the wear caused from breaking frozen lumps. For this reason, some operators run their coal crackers during the warmer months, merely to reduce the wear and to distribute it more evenly, but this consumes energy and certainly does not eliminate the wear.

SUMMARY OF THE INVENTION

A principal object of the present invention is to provide a material reducing unit which converts easily and conveniently from a material reducing capability to a more pass-through capability. Another object is to provide a unit of the type stated which is ideally suited for breaking up frozen lumps of coal so that it may be handled by coal conveying equipment, and for providing an unobstructed by-pass when no reduction is necessary. A further object is to provide a unit which enables frozen materials to be broken up during selected periods, yet does not experience any wear or consume any energy during other periods when its purpose is no longer necessary. An additional object is to provide a material handling facility embodying a unit of the type stated. These and other objects and advantages will become apparent hereinafter.

The present invention is embodied in a material handling facility including a hopper and a cracker unit that has a reducing machine which reduces large lumps or material that are introduced into it into smaller lumps. The cracker unit is capable of being moved from a position in which the reducing machine receives material from the hopper to a position in which the material does not pass through the machine. The invention also resides in the cracker unit itself, including a carriage having wheels, a reducing machine on the carriage, drive means on the carriage for driving the reducing machine, and a by-pass chute on the carriage. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur

DETAILED DESCRIPTION

Figures 1, 2:
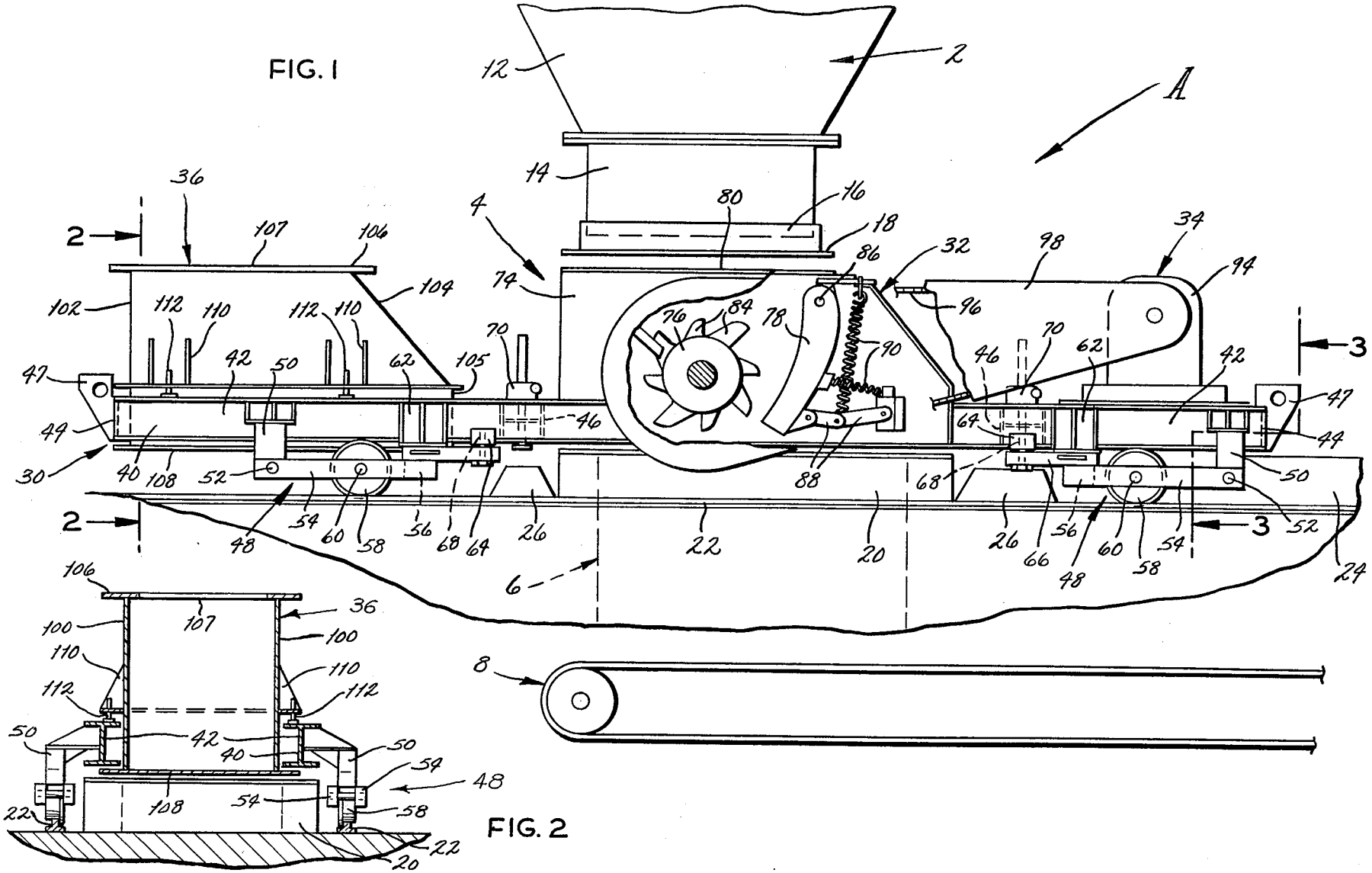
FIG. 1 is a side elevational view of a coal handling facility with the cracker unit thereof being supported on its carriage wheels for movement between its two positions, and also showing the material reducing machine broken away and in section.
FIG. 2 is a sectional view taken along line 2—2 of FIG. 1.

Referring now to the drawings, A (FIG. 1) designates a coal handling facility that basically includes a receiving hopper 2, a cracker unit 4 located below the receiving hopper 2, a discharge hopper 6 located immediately below the cracker unit 4, and a conveyor 8 located below the discharge hopper 6 for transporting coal that has passed through the cracker unit 6 away from the dumping facility to a location at which it is stored or consumed. Usually, the dumping facility A is in a pit, with the arrangement being such that rail cars pull directly over the receiving hopper 2 and release their coal into that hopper. However, the facility A may also be located within a coal storage area, in which case the coal is shoveled into the receiving hopper 2 or pushed into it with a bulldozer. The cracker unit 4 may be moved between two positions, and by virtue of this capability it has two modes of operation. In one mode, it permits coal to fall freely from the receiving hopper 2 to the discharge hopper 6. In the other mode it intercepts the coal and reduces it to lumps small enough in size to be handled by the conveyor 8 and similar equipment. The latter mode is used during winter when moisture in the coal tends to freeze and adhere the coal together in large massive lumps which cannot be handled by the conveyor 8 and other equipment.

The receiving hopper 2, which constitutes a delivery apparaus has a funnel-shaped portion 12 into which the coal is dumped or otherwise deposited. Being funnel-shaped, the portion 12 is considerably smaller at its lower end than at its upper end. The small lower end of the funnel-shaped portion 12 merges into a reduced end portion 14 that is of rectangular configuration. The end portion 14 lies directly above, yet is spaced from, the discharge hopper 6. Surrounding the end portion 14 of the receiving hopper 2 is a coupling collar 16 having a flange 18 at its lower end. The collar 16 is normally attached to the cracker unit 4, but when detached it may be moved upwardly over the outside surface of the end portion 14 on the hopper 2. A gap exists between the collar 16 and the end portion 14 and this gap is normally filled in some manner.

The discharge hopper 6 is a metal fabrication that directs falling coal onto the conveyor 8 that constitutes a collecting area. The hopper 6'' is surrounded at its upper end by a heavy concrete main foundation 20 beside which a pair of rails 22 pass (FIGS. 1 & 2), there being one rail 22 on each side of the main foundation 20. Beyond one end of the main foundation 20 is a storage foundation 24 which is likewise located between the two rails 22. The storage foundation 24 is about the same size and configuration as the main foundation 20. Beyond the ends of the two foundations 20 and 24 are jack pads 26 and more jack pads 26 are located between the two foundations 20 and 24. The jack pads 26 are frequently poured concrete. The cracker unit 4 together with the foundations 20 and 24, rails 22, and jack pads 26, in effect, constitute an installation for breaking up the frozen coal.

Figure 4:
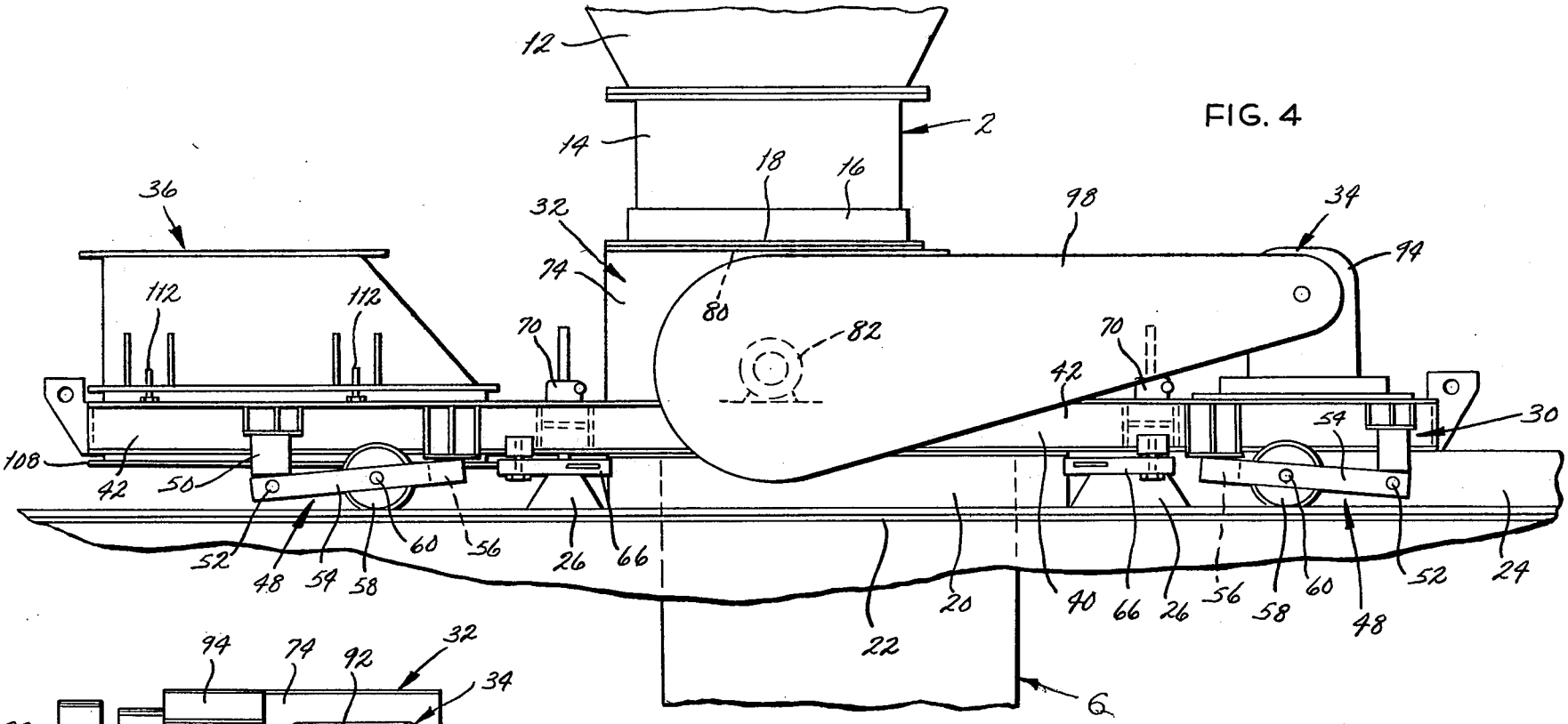
FIG. 4 is a side elevational view similar to FIG. 1, but showing the cracker unit lowered onto its foundations in the cracking position.

The cracker unit 4 occupies the space between the reduced end portion 14 of the receiving hopper 2 and the upper end of the discharge hopper 6 and is capable from moving on the rails 22 between a by-pass position (FIG. 5) and a cracking position (FIG. 4). In the by-pass position, the cracker unit 4 lets the coal fall without interference from the receiving hopper 2 to the discharge hopper 6. On the other hand, in the cracking position it intercepts the coal and reduces any large lumps within it to lumps of a smaller size which are suitable for being transported on the conveyor 8.

Figure 5:
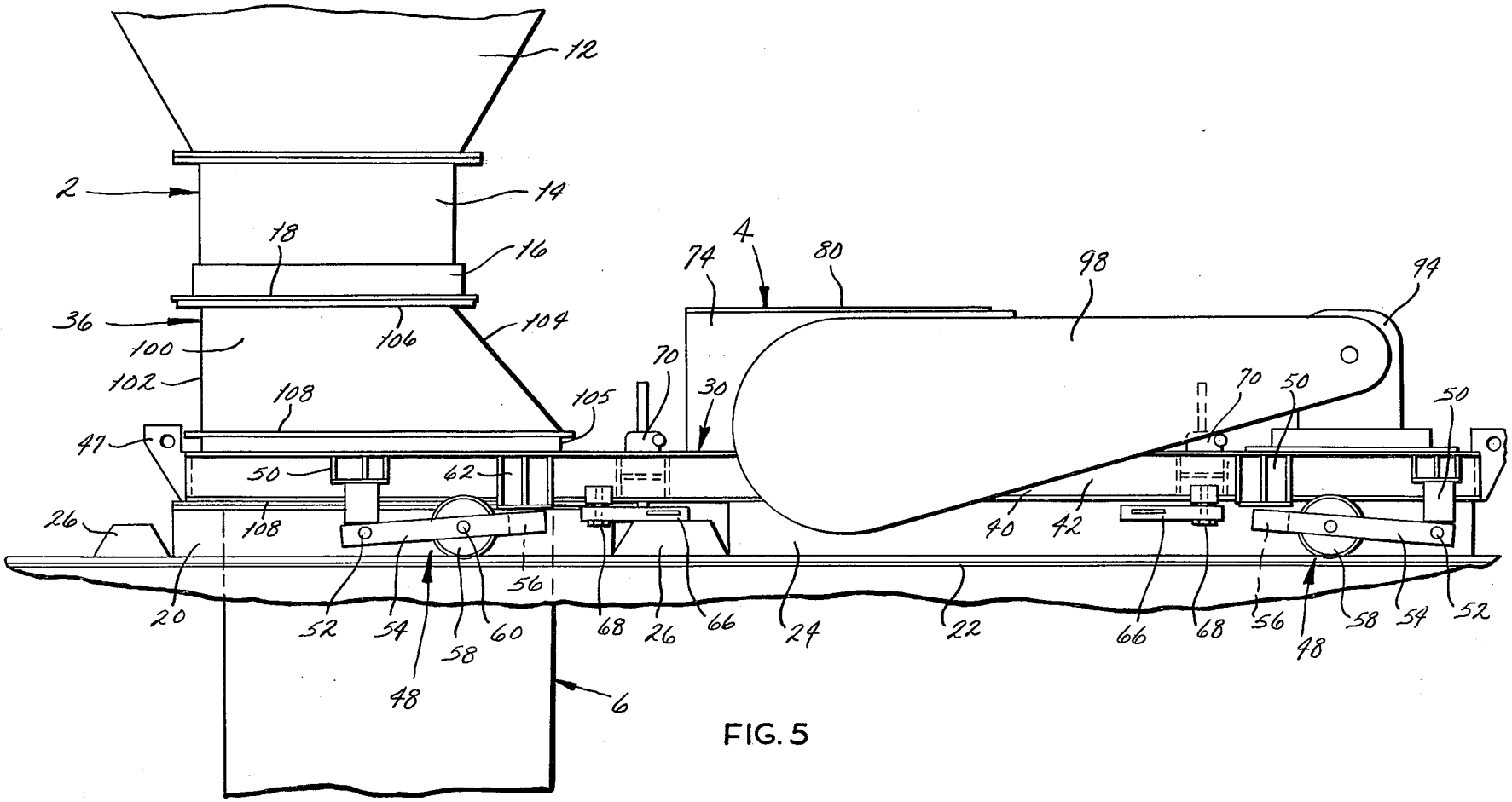
FIG. 5 is a side elevational view showing the cracker unit in its by-pass position.

The cracker unit 4 (FIG. 1) basically includes a carriage 30 as well as a reducing machine 32, a drive unit 34 for the reducing machine 32, and a by-pass chute 36, all of which are mounted securely on the carriage 30. The carriage 30 moves along the rails 22, and when it is in the cracking position, the reducing machine 32 is located between the end portion 14 of the receiving hopper 2 and the discharge hopper 6 (FIG. 4). However, when in the by-pass position, it locates the by-pass chute 36 between the end portion 14 of the receiving hopper 2 and the discharge hopper 6 (FIG. 5). While the entire cracker unit 4 is supported on the two rails 22 when moving between the two positions, whenever it is set in operation at either the by-pass position or the cracking position, it is supported on either one or both of the foundations 20 and 24.

Figure 3:
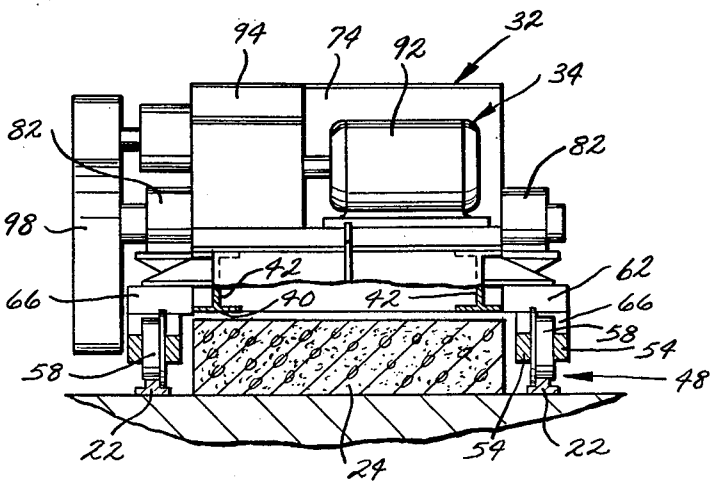
FIG. 3 is an end elevational view taken along line 3—3 of FIG. 1.

The carriage 30 has a frame 40 (FIGS. 1, 2 & 3) composed of a pair of longitudinal beams 42, that extend along the side of the carriage 30 for its entire length, and end and intermediate cross beams 44 and 46 that extend between and connect the two longitudinal beams 42. Each of the end cross beams 44 has a draw plate 47 welded to it, and each draw plate has an eye for attaching a cable to the carriage 30.

In the region of the drive unit 34 and also in the region of the by-pass chute 36, the frame 40 is fitted with wheel assemblies 48 (FIGS. 1, 2 & 3), those assemblies being arranged in pairs at each region and being generally located slightly beyond the longitudinal beams 42 of the frame 40. Each wheel assembly includes a pivot bracket 50 which extends downwardly from the adjacent longitudinal beam 42, and coupled to each pivot bracket 50 by means of a pivot pin 52 is a pair of support arms 54 which unless otherwise restrained are capable of swinging upwardly and downwardly away from their respective longitudinal beams 42. The free ends of the arms 54 of each pair are joined together by a short connecting member 56. The space between the two support arms 54 of each pair is located directly above one of the rails 22 and within this space is a flanged wheel 58 which is connected to the support arms 54 by a short axle 60 that extends between the two arms 54. The wheel 58 aligns with and bears against the rail 22. The free end of the pair of arms 54, that is the end to which the connecting member 56 is attached, is located beneath an abutment member 62 that projects outwardly from the longitudinal beam 42 on the frame 40.

Beyond the free ends of the support arms 54 for each pair, the frame 40 is provided with another pivot bracket 64 (FIG. 1) which projects outwardly from the longitudinal beam 42 of the frame 40, and to this bracket a spacer block 66 is attached by means of a vertical pivot pin 68. The bracket 64 positions the spacer block 66 such that it can swing horizontally into and out of the space between the abutment member 62 and the free ends of arms 54, assuming that the frame 40 is elevated high enough to provide sufficient space in that area to accommodate the spacer block 66.

The intermediate cross beams 46 for the frame 40 are offset slightly from the wheel assemblies 49, and these cross beams are fitted with jacks 70 (FIG. 1) which align with the jack pads 26 when the carriage 30 is in its cracking position. The jacks 70 may be either screw or hydraulically actuated. Irrespective of the method of actuation, the jacks 70 when lowered must be capable of elevating the frame 40 high enough to enable the spacer blocks 66 to move into and out of the spaces between their respective abutment members 62 and support arms 54. In this regard, when the frame 40 rises, the wheels 58 remain on the rails 22 by reason of the pivot connection between the arms 54 and their respective pivot brackets 50. Thus, the blocks 60 are swung into the spaces between the support arms 54 and the abutments 62 and when captured in this space, hold the frames in an elevated transport position and the wheel assemblies 49 in an extended transport position (FIG. 1). On the other hand, the jacks 70 must be capable of retracting sufficiently to clear the foundations 20 and 24 when the carriage 30 is supported on its wheel assemblies 49 in the transport position.

The reducing machine 32 is mounted on the carriage 30 generally between the two sets of wheel assemblies 48 and the two sets of jacks 70 as well, and includes (FIG. 1) a housing 74, a rotor 76 that revolves in the housing 74, an adjustable breaker plate 78 that is located within the housing 76 to one side of the rotor 76. The housing 74 itself is bolted to the two longitudinal beams 70 of the frame 40 and has an open bottom which locates directly above the discharge hopper 6 when the carriage 30 is in its cracking position. The upper end of the housing 74 has an inlet opening 80 which is located directly beneath the rectangular end portion 14 on the receiving hopper 2 when the carriage 30 is in the cracking position. Moreover, the coupling collar 16 drops downwardly onto the top of the housing 74 with its flange 18 surrounding the inlet opening 80 and may be bolted to the housing 74 along its flange 18.

The rotor 76 revolves quite slowly in two bearings 82 (FIGS. 3 & 4) which are supported on the housing 74 and is located directly below the inlet 80 in the housing 74 so that coal falling through the receiving hopper 2 is directed onto the top surface the rotor 76. The rotor 76 has teeth 84 (FIG. 1) which project outwardly and are inclined in the direction of rotation. The spacing between the teeth 84 is such that coal lumps of normal size will merely pass by the rotor 76 without being engaged sufficiently by the teeth to effect a reduction. This, however, does not hold true as to large lumps of coal, such as may be derived when a number of small lumps freeze together.

The breaker plate 78 is located to the side of the rotor 76 such that the teeth 84 on the rotor drive large lumps of coal into that plate and thereby effect a reduction in the size of those lumps. Extended through the upper end of the plate 78 is a pivot rod 86 which permits the breaker plate 78 to pivot toward and away from rotor 76. The lower end of the plate 78 is positioned by means of toggels 88 which are stabilized by springs 90. The toggels 88 and springs 90 permit the breaker plate 78 to yield and thus protect the reducing machine 32 against damage when overloading occurs.

Coal which enters the cracking machine 32 through its inlet 80 drops onto the rotor 76, and as a consequence of the relatively large spacing between the teeth and the slow angular velocity of the rotor 76, the smaller lumps of coal merely fall past the rotor 76 on both sides of it and pass into the discharge hopper 6. The larger lumps, which usually derive from a number of smaller lumps having been frozen together, are too large to pass by the rotor 76, and they are engaged by the teeth 84 of the rotor 76 and forced against the breaker plate 78. In effect, the large lumps are drawn or otherwise forced through a convergence between the plate 78 and rotor 76, and as this occurs the ice that bonds the numerous smaller lumps together fractures. Because the rotor 76 revolves at low speeds, few if any fines develop as the result of the cracking and a large amount of torque is available to effect the cracking.

The drive unit 34 is located on one end of the frame 40 for the carriage 30 and includes an electric or other suitable motor 92 (FIG. 3) and a speed reducer 94 to which the drive shaft of the motor 92 is coupled. The output shaft of the speed reducer 94 is in turn coupled with the rotor 76 of the reducing machine 32 through a chain drive 96 (FIG. 1) that extends along one side of the carriage 30. The chain drive 96 is encased within a shroud 98. The arrangement is such that the rotor 76 revolves at very low speeds on the order of 18 to 20 rev/min and is capable of developing a large amount of torque.

When the carriage 30 is in the cracking position (FIG. 4), the reducing machine 32 is located between the receiving and discharge hoppers 2 and 6, with the housing 74 of the cracking machine forming, in effect, a duct or chute between the two hoppers 2 and 6. However, when the carriage 30 is in the by-pass position (FIG. 5), the by-pass chute 36 is between the two hoppers 2 and 6 and serves to direct the falling coal from the former to the latter.

The by-pass chute 36 includes (FIGS. 1, 2, & 5) a pair of vertical side walls 100, a vertical end wall 102, an inclined end wall 104, and a short vertical end wall 105 that forms a continuation of the inclined wall 104, all of these walls being connected together to form a configuration somewhat similar to the housing 74 of the reducing machine 32. At their upper ends, the walls 100, 102, and 104 are provided with a peripheral flange 106 that delineates an inlet opening 107 which is the same size and shape as the inlet opening 80 on the reducing machine 32. Indeed, when the carriage 30 is in the by-pass position, the two flanges 18 and 106 are bolted together, thus connecting the end portion 18 of the receiving hopper 2 with the by-pass chute 36. The two side walls 100 extend downwardly between the two longitudinal beams 42 and have their lower margins slightly below the lower margins of the beams 42. Here the walls 100 are provided with outwardly directed flanges 108 which extend beneath the beams 42 such that when the frame 40 is lowered onto the main foundation 20 at the by-pass position, the flanges 108 are captured securely between the beams 42 and the foundation 20. The walls 100, 102 and 104 further have a common rib 110 which projects outwardly from them, and along the side walls 100 this rib is located slightly above the two carrier beams 42 on the frame. Threaded through the side portions of the rib 110 are leveling screws 112 which serve to level the by-pass chute 36 on the frame 40.

Operation

In use, the coal dumping facility A can easily be converted from the by-pass mode in which the coal drops directly from the receiving hopper 2 into the discharge hopper 6 without interference and the cracking mode in which the coal passes through the reducing machine 32 to fracture any large lumps that may be within it. To effect this conversion, the cracker unit 4 is moved along the rails 22 from the cracking position to the by-pass position or vice-versa.

Assuming that the cracker unit 4 is in its cracking position (FIG. 4), then of course the reducing machine 32 is located between the end portion 14 of the receiving hopper 2 and the discharge hopper 6. Also, the spacer blocks 66 are away from the ends of the support arms 54 for the wheel assemblies 48 and the jacks 70 are retracted so that the longitudinal beams 42 rest entirely on the main foundation 20. Indeed, the entire cracker unit 4 should be supported on the main foundation 20 before the reducing machine 32 is put into operation. Also, the flange 18 on the coupling collar 16 is bolted to the top wall of the housing 74 so as to couple the housing 74 with the end portion 14 of the receiving hopper 2. The space between the collar 16 and the end portion 14 is filled with the packing material to prevent any fines from escaping. As previously noted, coal passing downwardly into the inlet 80 of the reducing machine 32 will encounter the rotor 76, and if there are large lumps in this coal the teeth 84 on the rotor 76 will engage those lumps and force them against the breaker plate 78. This fractures the lumps into numerous smaller lumps which are more suitable for handling on the conveyor 8.

However, little, if any, need exists for the reducing machine 32 during warmer months of the year, and if left in position, it will only encounter wear. To avoid this wear, the cracker unit 4 is moved to its by-pass position, in which position the by-pass chute 36 is located between the receiving and discharge hoppers 2 and 6.

To move the cracker unit 4 to the by-pass position, the collar 16 is first detached from the top wall of the housing 74 on the reducing machine 32. It is then lifted upwardly to free it from the housing 74, and this usually requires removal of the packing that is located between the end portion 41 and the coupling collar 16. Then the jacks 70 are extended, in which case their feet will come against the jack pads 26. Further extension of the jacks 70 causes the entire frame 40, as well as the cracking machine 30 and by-pass chute 36 upon it, to rise upwardly away from the main foundation 20. The wheels 58, however, remain on the rails 22, since the support arms 54 which carry the wheels 58 pivot on their pivot pins 52. The jacks 70 are extended far enough to open the space between the abutment members 62 and the free ends of the support arms 54 sufficiently to accommodate the spacer blocks 66.

Once the necessary spacing between the abutment members 62 and the ends of the support arms 54 has been acquired, the spacer blocks 66 are swung horizontally on their pivot pins 68 into the space between the abutment members 62 and spacer arms 54. Then the jacks 70 are retracted and as the frame 40 lowers, the spacer blocks 66 become lodged tightly between the abutment members 62 and the free ends of the support arms 54, thus transferring the entire weight of the cracker unit 4 to the wheels 58 and the rails 22 on which they ride (FIG. 1). In this condition the longitudinal carrier beams 42 of the frame 40 are located above the main foundation 20 and the storage foundation 24 as well.

With the cracker unit 4 supported entirely on the wheels 58 and detached completely from the receiving hopper 2 and main foundation 20, a cable is connected to the drawplate 47 at the end of the carriage 30 which is occupied by the drive unit 34. This cable is drawn taut by a winch or some other drawing device which draws the entire cracker unit 4 along the rails 22, in which case it rolls with relative ease on its wheels 58. To prevent the jacks 70 from interferring with the foundations 20 and 24, the jacks 70 should be brought to their fully retracted positions.

After a short distance, the cracker unit 4 will assume its by-pass position, in which case, the by-pass chute 36 is located directly below the end portion 14 of the receiving hopper 2. The coupling collar 16 is then lowered and bolted to the flange 106 surrounding the inlet 107 at the upper end of the by-pass chute 36. Next the jacks 70 are again extended onto the appropriate jack pads 26 to raise the frame 40 just high enough to free the spacer blocks 66. The spacer blocks 66 are swung outwardly so that they no longer occupy the spaces between their respective abutment members 62 and support arms 54, and this renders the wheels 58 incapable of supporting the carriage 30. The jacks 70 are then retracted slowly to lower the frame 40 down upon the two foundations 20 and 24. The portion of the frame 40 at which the by-pass chute 36 is located rests upon the main foundation 20 with the flange 108 of the chute 36 being captured by the longitudinal beams 42 and the upper surface of the main foundation 20 (FIG. 5). The portion of the frame 40 that supports the reducing machine 32 and drive unit 34, on the other hand, drops down onto the storage foundation 24 with the longitudinal carrier beams 42 resting directly upon that foundation.

The cracker unit 4 is returned to its cracking position through an opposite sequence of events.

Since the reducing machine 32 can be moved to a position outside the flow of coal when it is not needed, the life of the machine is prolonged considerably.

This invention is intended to cover all changes and modifications of the example of the invention herein chosen for purposes of the disclosure which do not constitute departures from the spirit and scope of the invention.

What is claimed is:

1. In a facility for handling lump materials, such as coal, and including a hopper and a collecting area below the hopper, an improved unit between the hopper and the collecting area for breaking up large lumps of the material, said unit comprising: a base that is capable of being moved with respect to the hopper and the collecting area between first and second positions; a reducing machine mounted in a fixed position on the base and having an inlet that aligns with the hopper when the base is in its first position, but not when in its second position, the machine having the capability of reducing lump material that enters the machine through the inlet to lumps of smaller size, whereby any large lumps of material entering the hopper will be reduced to lumps of smaller size only when the base is in its first position and a by-pass chute mounted on the base in a fixed position with respect to the reducing machine, the by-pass chute having an inlet that is located at substantially the same elevation as the inlet on the reducing machine and aligns with the hopper when the base is in its second position, but not when in its first position, the by-pass chute being configured to completely surround the material as the material drops through it and to direct the material from the hopper to the collecting area.

2. The combination according to claim 1 wherein the base is a carriage including a frame on which the reducing machine is supported and wheels connected to the frame for supporting it in a elevated position.

3. The combination according to claim 2 and further comprising a drive unit on the carriage for driving the reducing machine, the by-pass chute being located beyond one end of the reducing machine and the drive unit being located beyond the other end of the reducing machine.

4. The combination according to claim 2 and further comprising a foundation at the collecting area, and configured to support the carriage, and means for raising the frame of the carriage up away from and for lowering the frame onto the foundation.

5. The combination according to claim 4 wherein the wheels of the carriage are retractable with respect to the frame to enable the frame to rest upon the foundation, but when extended support the frame above the foundation.

6. The combination according to claim 4 wherein the means for raising and lowering the carriage comprises jacks that are attached to the frame of the carriage.

7. The combination according to claim 6 and further comprising rails at the collecting area, and wherein the wheels of the carriage roll along the rails when the carriage moves between positions.

8. The combination according to claim 4 wherein the carriage has wheel assemblies, each including at least one support arm that pivots upwardly and downwardly with respect to the frame with a wheel of the carriage being mounted on the arm for rotation relative to the frame, and means for retaining the support arm in a transport position wherein the frame of the carriage is high enough to clear the foundation.

9. The combination according to claim 8 wherein the means for retaining the support arm in the transport position comprises a spacer that fits between the arm and the frame.

10. The combination according to claim 9 wherein the spacer pivots relative to the frame into and out of the space between the support arm and the frame.

11. The combination according to claim 4 and further comprising a lower hopper located in the collecting area below the upper hopper and the foundation extends along the lower hopper.

12. The combination according to claim 4 wherein the foundation is located below the reducing machine when the carriage is in its first position; and wherein the combination further comprises a storage foundation that is located below the reducing machine when the carriage is in its second position.

13. A cracker unit for breaking up material, such as coal, that is delivered to it through a delivery apparatus in a frozen condition in which the material is held together in relatively large lumps, so as to reduce the material to smaller lumps, said cracker unit comprising: a carriage having wheels which enable the cracker unit to move between first and second positions with respect to a delivery apparatus, a reducing machine mounted in a fixed position on the carriage and having an inlet that is below and aligns with the delivery apparatus when the carriage is in its first position, but not when the carriage is in its second position, the reducing machine further having means for reducing frozen material into smaller lumps; drive means on the carriage for driving the reducing machine; and a by-pass chute mounted in a fixed position on the carriage adjacent to the reducing machine and having an inlet that is below and aligns with the delivery apparatus when the carriage is in its second position, but not when in its first position, the by-pass chute being configured to completely surround the material that drops through it from the delivery apparatus.

14. A cracker unit according to claim 13 wherein the carriage has a frame and the wheels are retractable toward and extensible away from the frame.

15. A cracker unit according to claim 14 and further comprising means for holding the wheels in an extended transport condition wherein the frame is elevated as compared to when the wheels are in the retracted position.

16. A cracker unit according to claim 14 and further comprising jacks on the carriage for elevating the carriage frame.

17. A cracker unit according to claim 13 wherein the reducing machine includes a housing mounted on the carriage, with the inlet for the cracking machine being in the housing, and the means for reducing the frozen material includes a rotor in the housing below the inlet and having teeth for engaging large lumps of material, the rotor being connected to and rotated by the drive means, and breaker means in the housing to the side of the rotor for providing a surface against which the large lumps of material are forced as they are acted upon by the rotor.

18. In a material handling facility that includes a delivery apparatus for receiving lump material, such as coal, which is often frozen into larger lumps, and also includes a collecting area below the delivery apparatus, an installation located between the delivery apparatus and the collecting area for breaking up the frozen lump material into smaller lumps, said installation comprising: horizontal rails located below the delivery apparatus in a fixed position with respect thereto; carriage means for movement along the rails and including wheels which roll on the rails and enable the carriage means to change position with regard to the delivery apparatus and the collecting area; a reducing machine supported on the carriage means and including an inlet that aligns with the delivery apparatus when the carriage means is moved to the proper position and further including means for engaging frozen lump material that enters through the inlet and for reducing that lump material to lumps or smaller size; and a by-pass chute mounted on the carriage means and including an inlet that is located at substantially the same elevation as the inlet on the reducing machine and aligns with the delivery apparatus when the carriage means is moved to the proper position, so that lump material when it is not frozen may pass to the collecting area through the by-pass chute without passing through the reducing machine, the by-pass chute being configured to completely surround the lump material as it leaves the delivery apparatus and passes through the by-pass chute.

* * * * *